US008353250B2

(12) United States Patent
Preston

(10) Patent No.: US 8,353,250 B2
(45) **Date of Patent: *Jan. 15, 2013**

(54) QUILT BLANK, METHOD OF MAKING A QUILT USING A QUILT BLANK AND QUILT KIT INCLUDING QUILT BLANK

(75) Inventor: Nancy Claire Preston, Great Falls, VA (US)

(73) Assignee: Nancy Claire Preston, Great Falls, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/064,285

(22) Filed: Mar. 16, 2011

(65) Prior Publication Data

US 2011/0168069 A1 Jul. 14, 2011

Related U.S. Application Data

(62) Division of application No. 11/802,650, filed on May 24, 2007, now Pat. No. 7,926,433.

(51) Int. Cl.
*D05B 11/00* (2006.01)
*B32B 1/00* (2006.01)

(52) U.S. Cl. ..... 112/117; 112/439; 112/475.08

(58) Field of Classification Search ..... 112/117, 112/439–441, 475.08–475.18; 5/482, 502
See application file for complete search history.

(56) References Cited

U.S. PATENT DOCUMENTS

| | | | |
|---|---|---|---|
| 1,347,642 | A | 7/1920 | McNatt |
| 2,574,064 | A | 11/1951 | Rosen |
| 2,808,596 | A | 10/1957 | Schreiner |
| 3,325,832 | A | 6/1967 | Malicki |
| 3,570,435 | A | 3/1971 | Morrison |
| 3,649,400 | A | 3/1972 | Sawaki et al. |
| 3,799,161 | A | 3/1974 | Collins |
| 4,355,722 | A | 10/1982 | Lemmeyer |
| 4,506,616 | A | 3/1985 | Nixon |
| 4,514,175 | A | 4/1985 | Zaruba et al. |
| 4,631,765 | A | 12/1986 | Casey |
| 4,814,218 | A | 3/1989 | Shane |
| 4,912,850 | A | 4/1990 | Gray |
| 4,949,415 | A | 8/1990 | Selga |
| 5,099,773 | A | 3/1992 | Codos |
| 5,133,254 | A | 7/1992 | Kirkwood |

(Continued)

OTHER PUBLICATIONS

*How to Make a Quilt—WikiHow*, http://www.wikihow.com, printed on Feb. 27, 2007 (6 pages).

*Primary Examiner* — Ismael Izaguirre
(74) *Attorney, Agent, or Firm* — Nixon & Vanerhye, P.C.

(57) ABSTRACT

The disclosure is directed to a quilt blank, a quilt kit including a quilt blank and method of making a quilt using a quilt blank. The disclosure describes a quilt blank including a partially completed quilt having a quilt top, backing and batting material interposed between the quilt top and the backing, all of which are secured together via a sewing or quilting pattern. The quilt top of the quilt blank includes at least one predetermined blank portion sized to receive a fabric swatch or other material selected by a user. Alternatively, the quilt blank may simply be a quilt top having a predetermined blank area to be filled with a fabric swatch or other material. The disclosure also describes a quilt kit including a quilt blank and a method of making a quilt using a quilt blank.

22 Claims, 4 Drawing Sheets

U.S. PATENT DOCUMENTS

| | | | | |
|---|---|---|---|---|
| 5,226,468 | A | 7/1993 | Lord | |
| 5,898,962 | A * | 5/1999 | McNeal | 5/639 |
| 5,899,160 | A | 5/1999 | Hoang | |
| 6,357,370 | B1 | 3/2002 | Fritz et al. | |
| 6,443,081 | B1 | 9/2002 | Quint | |
| 6,557,192 | B2 * | 5/2003 | Zheng | 5/413 R |
| 6,640,362 | B1 | 11/2003 | Kimball | |
| 6,696,129 | B1 | 2/2004 | Cotton | |
| 6,722,300 | B2 | 4/2004 | Trobaugh et al. | |
| 7,107,638 | B2 | 9/2006 | Wilson | |
| 7,757,416 | B2 * | 7/2010 | Shearrow et al. | 38/102.91 |
| 2003/0227202 | A1 | 12/2003 | Endicott et al. | |

* cited by examiner

QUILT BLANK, METHOD OF MAKING A QUILT USING A QUILT BLANK AND QUILT KIT INCLUDING QUILT BLANK

CROSS REFERENCE TO RELATED APPLICATIONS

This is a divisional application of U.S. patent application Ser. No. 11/802,650, filed May 24, 2007, now U.S. Pat. No. TBD.

TECHNICAL FIELD

The present disclosure relates to the art of quilt making. In particular, the disclosure is directed to a novel quilt kit and method of making a quilt, wherein a quilt blank that includes at least a quilt top having predetermined blank patterns incorporated therein is provided to a user. The user may then create a completed quilt by incorporating materials of the user's choosing into the predetermined blank portion(s) provided in the quilt top portion of the quilt blank. The user may thus enjoy the art of creating a quilt, including, for example, fabric selection, color composition, or the like, without having to perform all of the labor intensive and time consuming steps previously required to make a quilt from scratch.

BACKGROUND

Related Art

Conventional quilt making is a labor intensive and time consuming art. In prior quilt making, the quilter was typically required to construct the quilt from scratch. As illustrated in FIG. 1, which is an exploded perspective view of a quilt 10, the quilt 10 is typically made up of three major component parts: a quilt top 2, optionally including a pattern 8; a backing 6; and batting 4 interposed between the quilt top and the backing.

Typically, when creating a quilt, a quilter first selects a pattern and fabric for the quilt top. The pattern may be designed by the quilter or may be purchased as part of a quilt kit (discussed in greater detail below). The fabric may include, for example, new fabric, vintage fabric, heirloom fabrics, etc. or any combination thereof. Hobbyist quilters typically have large collections of fabric, sometimes referred to as a "stash" that might include fabrics that have special significance or meaning to the quilter or to the recipient of a quilt. Examples of such types of fabric may include, for example, old baby clothes, silk ties, t-shirts, or any other memorable or keepsake textiles. After selecting the pattern and fabric, the pieces that make up the quilt top must be cut out precisely according to the pattern so that the pieces that make up the resulting quilt top will align properly. Each of the pieces or blocks that make up the quilt top are then pieced, or sewn, together at their edges and the result is a quilt top having a desired pattern made up of fabrics selected by the user.

After completing the quilt top, the quilter may select a batting material. Batting materials are available in a wide variety of shapes and types. For example, high loft batting that is thicker and will make a fluffier quilt though it may be more difficult to sew or stitch, while low loft batting is thinner and may be easier to quilt, but will not provide the warmth of a higher loft batting. The batting material may be selected based on a variety of factors that are peculiar to the quilter.

Once the batting material has been selected, the next step is generally to choose a backing material. Backing material is typically a large block of solid fabric. The backing should be at least as large as the quilt top. To that end, the backing may, for example, be made up of more than one piece of fabric, depending upon the size of the quilt, the amount and size of available backing material, and the like.

After the quilt top is completed, and the batting and backing have been selected, the quilt top, batting and backing are aligned with the batting material interposed between the quilt top and the backing material. The quilter may then sew the various layers together in a predetermined quilting or sewing pattern, such as, for example, a quilting pattern selected by the quilter, a quilting pattern based on the pattern of the quilt top, etc. The sewing pattern (also referred to herein as quilting) in combination with the batting material interposed between the quilt top and backing provide the final quilt appearance.

Once all of the layers have been sewn or stitched together, the edges of the quilt may be completed by finishing the edges. Edge finishing, also referred to as binding, may be accomplished using any of a number of known techniques including, for example, using bias tape sewn along the edges, using a predetermined material as a substitute for bias tape and sewing this material around the edges, using the backing fabric folded over the edges and sewn together, etc.

Quilt kits have been available for some time to assist quilters in creating quilts. These quilt kits may include patterns that the quilter may use with his or her own fabric to make the quilt top. On the other hand, quilt kits that provide both the pattern and the material for use in making the quilt top are also available. Generally, quilt kits provide patterns and/or materials for making the quilt top. The user must then separately select and incorporate the batting and backing as discussed above.

As can be appreciated from the above, quilt making is a highly labor intensive and time consuming activity. Even the use of quilt kits to assist the quilter in selecting a pattern and/or fabrics to use in forming the quilt top do not substantially reduce the time and effort involved in constructing a quilt from scratch. Moreover, the use of quilt kits are disadvantageous in that they may reduce or even eliminate the creative aspect of making a quilt. Thus, when using a quilt kit, the creative aspects of quilt making may no longer be something that the quilter can enjoy.

Additionally, consumers have been known to save fabrics over time with the intention of making a quilt from these fabrics, such as, for example, a memory quilt. These saved fabrics may sometimes be referred to as a quilt stash. However, due to the time and effort involved in making a quilt, these consumers may only partially complete a quilt project, or may never embark on the project to begin with. Sometimes after a quilt project is started, the quilter may not have the time or energy to complete the project and may have to hire someone to complete the job. Additionally, the amount of fabric in the stash may not be sufficient to make a quilt top. Consumers may also provide the fabric and pattern to a third party who will then complete the quilt. These alternatives detract from the enjoyment of making a quilt and may result in the project being perceived as a chore instead of a satisfying exercise.

BRIEF SUMMARY

We now recognize that what is needed is a way to provide the consumer with a quilt blank or quilt kit including a quilt blank that enables the consumer to incorporate fabrics of their choosing, such as, for example, heirloom fabrics including, for example, old baby clothes, silk ties, t-shirts, or any other memorable or keepsake textiles, in a quilt design and complete the quilt without incurring the time and expense of making a quilt from scratch or from a conventional quilt kit. This may provide the consumer with the satisfaction associated with completing a quilting project and incorporating fabrics or other materials of their own choosing without incurring the time, expense and frustration that may sometimes accompany a quilting project that involves making a quilt from scratch or from a conventional quilt kit.

According to an exemplary embodiment, a quilt blank is provided for a user, wherein the quilt blank comprises: a quilt top having a predetermined blank portion being sized to receive a fabric swatch or other material, such as, for example, and without limitation, ribbons, photographs, or the like, from the user; a backing material; and a batting material interposed between the quilt top having a predetermined blank portion and the backing material, the quilt top having a predetermined blank portion, the backing material and batting material being secured to each other by a sewing or quilting pattern. The term blank as used herein refers to a portion of a larger piece of fabric or patterned material that includes an area having a predetermined size and shape that does not include the fabric of the larger piece or pattern thereby forming an area devoid of fabric or material that may be subsequently filled using material of a suitable size and shape.

According to this exemplary embodiment, a user is essentially provided with a partially completed quilt having at least one predetermined blank pattern provided in the quilt top. This blank pattern may be filled by the user with fabric of the user's choosing, such as, for example, new fabric, vintage fabric, heirloom fabric, such as, for example, old baby clothes, silk ties, t-shirts, or any other memorable or keepsake textiles, or the like, or may optionally include other materials, such as, for example, ribbons, photographs, etc. Of course, there may be more than one predetermined blank area provided in the quilt top of the quilt blank, and these predetermined blank areas may be of varying sizes, shapes, patterns, etc. It is also envisioned that the quilt top pattern may be selected by the provider of the quilt blank, may be made in accordance with a pattern designed by the user, may be the result of collaboration between the quilt blank provider and the user, or any other basis. The term quilt and quilt blank, as used herein, is intended to be illustrative, not limiting. In this connection, it will be understood that quilt or quilt blank may include, without limitation, any quilted article, such as, for example, and without limitation, pillows, pillow covers, bed spreads of standard and non-standard bed sizes, throws, wall hangings, pot holders, oven mitts, bags, clothing, decorative items, religious articles, holiday articles, etc.

According to another exemplary embodiment, a quilt blank is provided for a user, wherein the quilt blank comprises: a quilt top having a predetermined blank portion being sized to receive a fabric swatch or other material, such as, for example, and without limitation, ribbons, photographs, or the like, from the user. According to this exemplary embodiment, a user is provided with an essentially completed quilt top having at least one predetermined blank pattern provided therein. This blank pattern may be filled by the user with fabric of the user's choosing, such as, for example, new fabric, vintage fabric, heirloom fabric, such as, for example, old baby clothes, silk ties, t-shirts, or any other memorable or keepsake textiles, or the like, or may optionally include other materials, such as, for example, ribbons, photographs, etc. Of course, there may be more than one predetermined blank area provided in the quilt top of the quilt blank of this embodiment, and these predetermined blank areas may be of varying sizes, shapes, patterns, etc. It is also envisioned that the quilt top pattern may be selected by the provider of the quilt blank, may be made in accordance with a pattern designed by the user, may be the result of collaboration between the quilt blank provider and the user, or any other basis. Further, according to this embodiment, the user may purchase or be provided with separate batting and backing material, which the user may then use in conjunction with the quilt top made using the quilt blank, and sew or quilt all three quilt components together using a sewing or quilting pattern to complete the quilt.

In accordance with yet another exemplary embodiment, a method of making a quilt comprising: providing a quilt blank for completion by a user, the quilt blank comprising: a quilt top having a predetermined blank portion being sized to receive a fabric swatch or other material, such as, for example, and without limitation, ribbons, photographs, or the like, from the user; a backing material; and a batting material interposed between the quilt top having a predetermined blank portion and the backing material, wherein the quilt top having a predetermined blank portion, the backing material and batting material are secured to each other by a sewing pattern; and filling in said predetermined blank portion of said quilt blank with a fabric swatch or other material to complete the quilt.

In accordance a further exemplary embodiment, a method of making a quilt comprising: providing a quilt blank for completion by a user, the quilt blank comprising: a quilt top having a predetermined blank portion being sized to receive a fabric swatch or other material, such as, for example, and without limitation, ribbons, photographs, or the like, from the user; filling in said predetermined blank portion of said quilt blank with a fabric swatch or other material to complete the quilt top; and combining the completed quilt top with a batting material and a backing using a sewing pattern to complete the quilt.

Yet another exemplary embodiment is a quilt kit including a quilt blank that is provided to a user. The quilt kit comprises: a quilt blank having a predetermined blank portion sized to receive a fabric swatch or other material, such as, for example, and without limitation, ribbons, photographs, or the like, from the user. The quilt blank provided in the quilt kit may be an essentially completed quilt including a quilt top having a predetermined blank portion sized to receive a fabric swatch or other material selected by the user, wherein the quilt top including the blank portion is secured to a backing material with batting material interposed therebetween using a stitching or quilting pattern. Alternatively, the quilt kit may simply include a quilt top having a predetermined blank portion sized to receive a fabric swatch or other material from the user. This alternative quilt kit may optionally include one or more of separate batting material, backing material, thread, quilting needles, instructions, etc.

The various non-limiting exemplary embodiments described herein overcome numerous disadvantages associated with prior art quilting methods and quilt kits, some of which are enumerated above, by providing a quilt blank and method for quilting using a quilt blank that enable a consumer or user to enjoy the art of quilt making, incorporating selected materials, including stash materials, into a completed quilt without having to commit the time and effort required to make a quilt from scratch.

The advantages attendant with the various embodiments described above are provided by the quilt blank, method of quilting using a quilt blank and quilt kit disclosed and described herein with reference to the drawings.

BRIEF DESCRIPTION OF THE DRAWINGS

The exemplary embodiments will be better understood and appreciated in conjunction with the following detailed description of exemplary embodiments taken together with the accompanying drawings in which like reference numerals refer to like elements, and wherein.

DETAILED DESCRIPTION OF EXEMPLARY EMBODIMENTS

Figure 1:
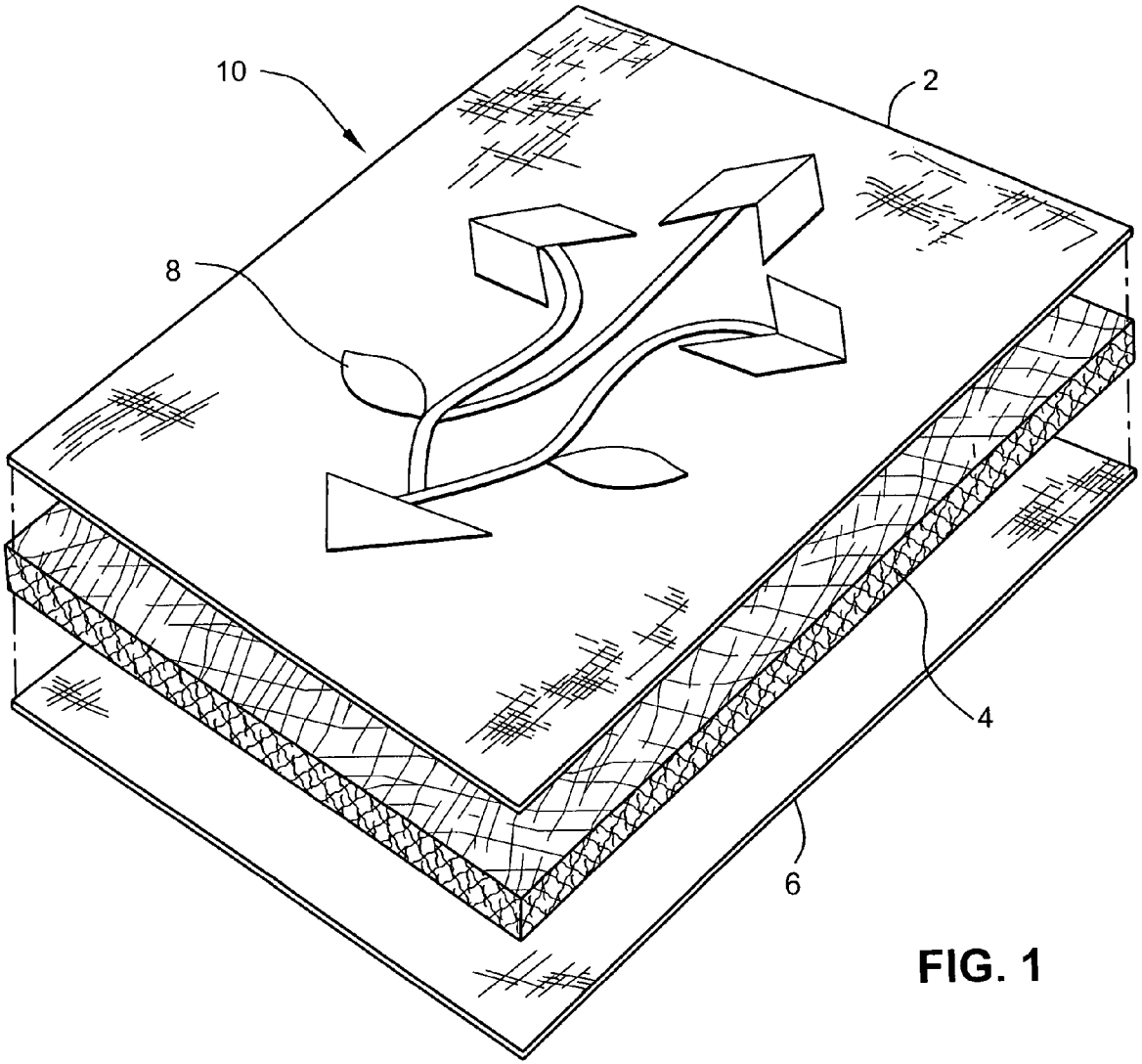
FIG. 1 is an illustrative exploded perspective view of selected components that make up a quilt.

FIG. 1 is an illustrative exploded perspective view of selected components that make up a quilt. This figure denotes major components of a quilt, but may not illustrate all components. For example, the sewing or quilting pattern that is used to secure the illustrated components and the finished edge are not shown. As shown in FIG. 1, a quilt 10, is generally made up of a quilt top 2 and a quilt backing 6 having a batting material 4 interposed therebetween. The quilt top 2, quilt backing 6 and interposed batting material 4 are typically secured by a sewing method known as quilting (not shown). The quilt top 2 may include a pattern or design 8. The quilt top 2 may be made up of a large piece of material with the pattern or design portion 8 being made of other blocks or patterns of material, or may optionally be comprised of a number of material blocks that when stitched or pieced together form the pattern or design 8 in the quilt top 2. The manner in which the quilt top is formed is optional, and is not limited to the foregoing examples.

As described above, in conventional quilt making, the quilter may make the quilt top 2 using an original design or pattern, or may purchase a quilt kit that includes a quilt top design and may optionally also include the material for making the quilt top. After the quilter assembles the quilt top 2, the quilter may assemble a quilt backing 6. The backing 6 may be made of a single piece of material or may comprise several pieces or panels of material that are secured together, for example, by sewing. The backing 6 should be at least as large as the quilt top. Upon completion of the quilt top 2, including pattern 8, and the quilt backing 6, the quilter may select a batting material 4 based on the type of quilt that is desired. As discussed above, batting material is available in many different shapes, sizes and lofts. Higher loft materials are generally thicker and will make a warmer fluffier quilt (although typically harder to sew), while low loft batting is thinner and may be easier to quilt, but will not provide the warmth of a higher loft batting.

After the quilt top 2 is completed, and the batting 4 and backing 6 have been selected, the quilt top 2, batting 4 and backing 6 are aligned with the batting material 4 interposed between the quilt top 2 and the backing material 6. The quilter may then sew the various layers together in a predetermined quilting or sewing pattern (not shown), such as, for example, a quilting pattern selected by the quilter, a quilting pattern based on the pattern of the quilt top, etc. The quilting or sewing pattern in combination with the batting material 4 interposed between the quilt top 2 and backing 6 provide the final quilt 10 appearance.

Once all of the layers have been sewn together, the edges of the quilt (not shown) may be completed by finishing the edges. Edge finishing, also referred to as binding, may be accomplished in any of a number of known techniques including, for example, using bias tape sewn along the edges, using a predetermined material as a substitute for bias tape and sewing this material around the edges, using the backing fabric folded over the edges and sewn together, etc.

Figure 2:
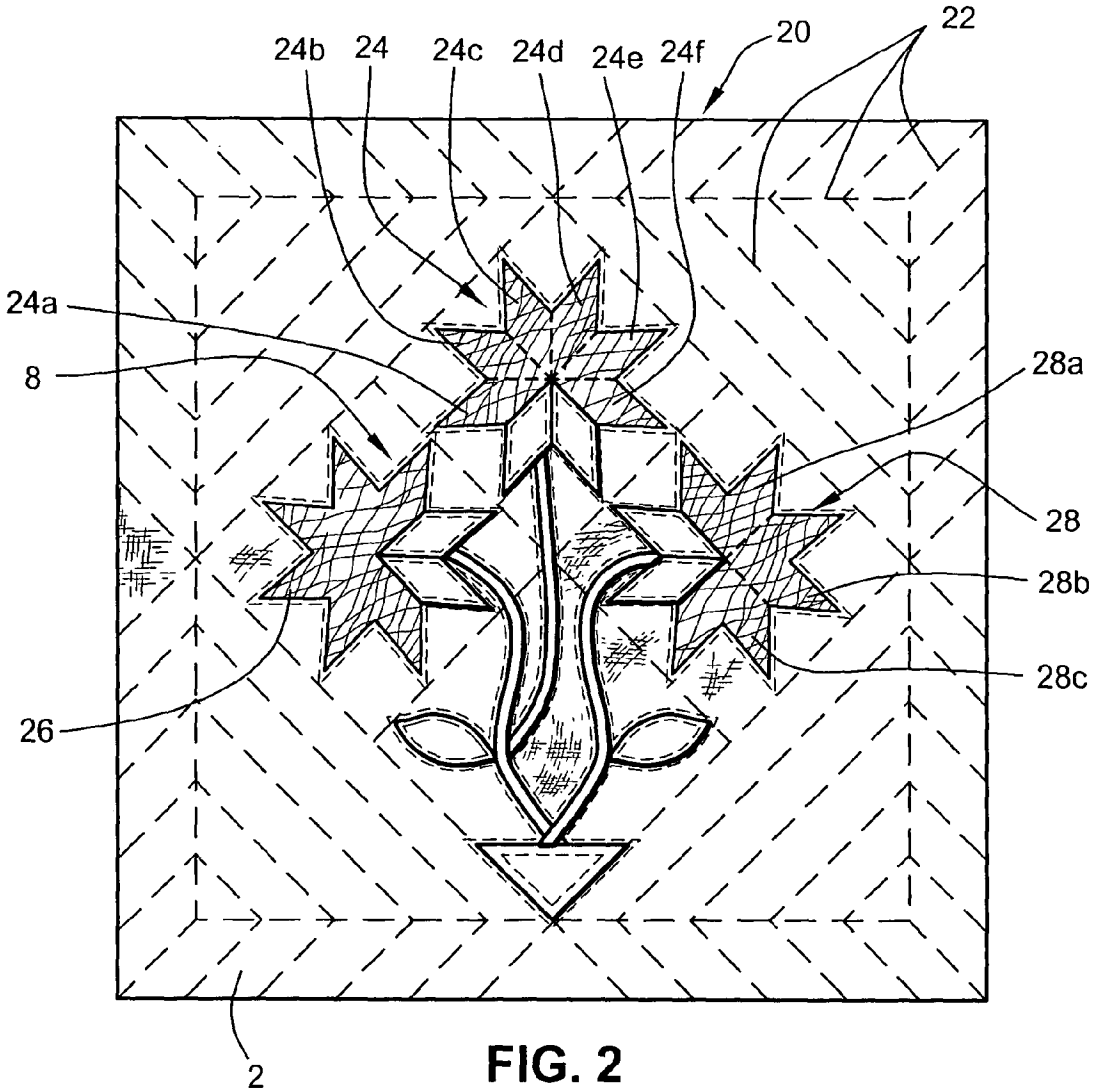
FIG. 2 is an illustrative drawing showing a quilt blank having predetermined blank portions sized to receive a fabric swatch or other material.

Referring now to FIG. 2, an exemplary quilt blank according to an illustrative non-limiting embodiment is shown. The quilt blank 20 includes, for example, in this illustration, a quilt top 2, including quilt pattern 8, having blank portions 24, 26, 28, batting and backing (not shown). The quilt top 2, the batting and backing are secured by sewing or quilting pattern 22. As shown in FIG. 2, the pattern 8 on the quilt top 2 may include blank portions such as, for example, blank portions 24, 26 and 28. The number of blank portions may be as few as one, and may include multiple blank portions, as illustrated. It is to be understood that the number of blank portions may be any number greater than or equal to one. These blank portions 24, 26 and 28 are provided in a partially completed quilt that forms the quilt blank 20. The material used to fill these blank portions may be any type of material selected by the user, such as, for example, and without limitation, new fabric, vintage fabric, heirloom fabrics including, for example, old baby clothes, silk ties, t-shirts, or any other memorable or keepsake textiles, or the like, or may optionally include other materials, such as, for example, ribbons, photographs, etc. Typically, hobbyist quilters keep a stash of materials for use in making a quilt, the stash may include, without limitation, any of the foregoing material types.

Additionally, the blank portions 24, 26 and 28 may be made up of multiple blank portions, or subportions, e.g., 24*a-f* and 28*a-c*, based on the type of pattern desired and size of materials being used. These subportions may be dictated by the designer of the blank or by the user. Optionally, each of the blank portions 24, 26 and 28 may be made up of a single pattern, such as, for example, illustrated by blank portion 26.

In use, the quilt blank 20 is completed by a user who purchased the quilt blank 20. As discussed above, the pattern 8 that is incorporated in the quilt top 2 of the quilt blank 20 may be any design. The design of the pattern 8 may be solely that of the quilt blank provider, may be a design dictated by the user, may be a collaboration of the user and the quilt blank maker, or any other pattern. Enabling the user to participate in designing the pattern 8 may provide further commercial benefits to the quilt blank manufacturer, and creative satisfaction to the user.

After the user obtains the quilt blank 20, the user may select any type of material to fill in the blank portions 24, 26, 28 of the quilt blank 20. The user will pattern and cut the materials to fit the blank portions 24, 26, 28, as appropriate. For example, one large block of cloth or other material may be used to fill in blank portion 26, while six separate smaller blocks of cloth or other material may be used to fill in blank portion 24 (24*a*-24*f*), and three separate intermediate size blocks of cloth or other material may be used to fill in blank portion 28 (28*a*-28*c*). The blank portions 24, 26, 28 are filled in by patterning the selected material, cutting it to size, and sewing the patterned material into the appropriate areas within the blank portions. Once the patterned blocks of material (not shown) are incorporated into the blank portions 24, 26, 28, the user may optionally complete the sewing or quilting pattern 22 through the newly incorporated material.

Figure 3:
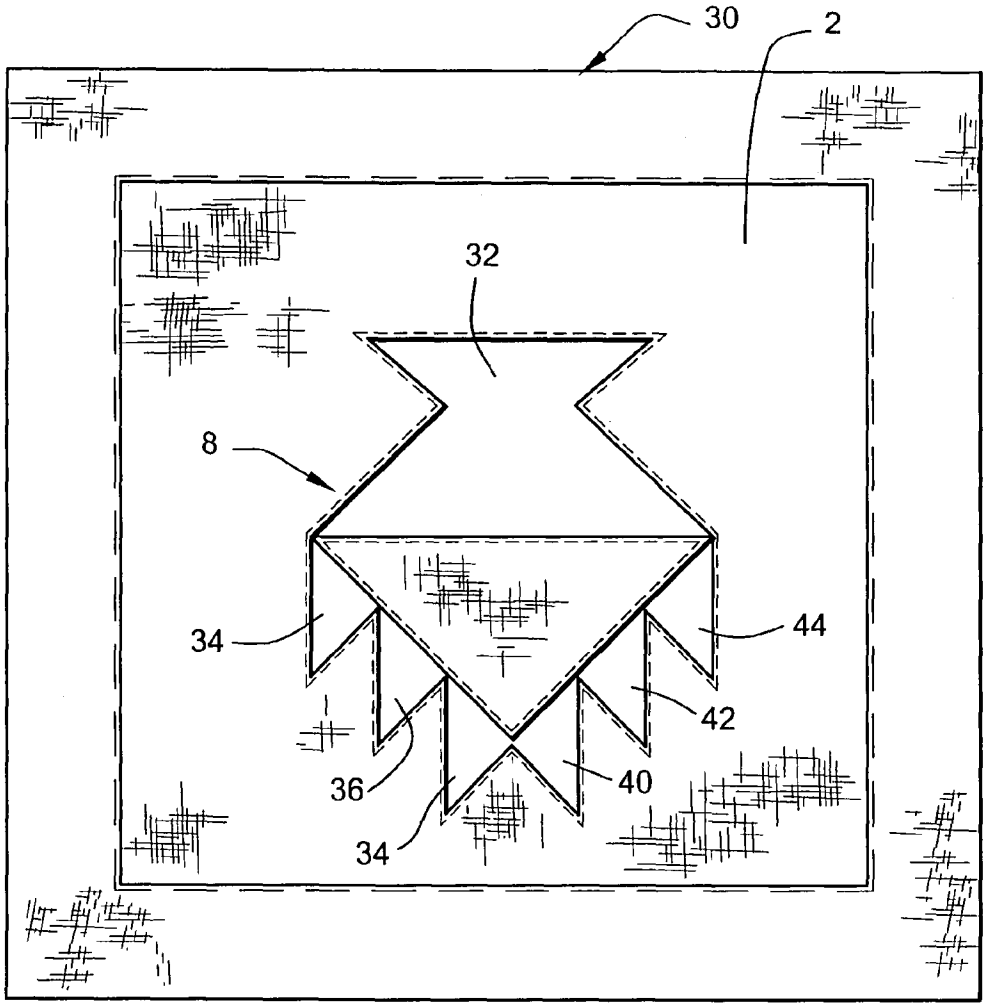
FIG. 3 is an illustrative drawing of another quilt blank having predetermined blank portions sized to receive a fabric swatch or other material.

With reference to FIG. 3, another exemplary embodiment is illustrated. According to this exemplary non-limiting illustrative embodiment, the quilt blank 30 includes only a quilt top 2 having predetermined blank portions 32, 34, 36, 38, 40, 42, 44. This embodiment is similar to that illustrated in FIG. 2, except that this embodiment only includes a quilt top 2. The batting and backing materials are not included and must be added later by the user as will be described herein.

As with the embodiment described above with respect to FIG. 2, blank portions 32, 34, 36, 38, 40, 42, 44 may be made up of subportions (not shown) and may be based on the type of pattern desired and size of materials being used. These subportions may be dictated by the designer of the blank or by the user. Optionally, each of the blank portions 32, 34, 36, 38, 40, 42, 44 may be made up of a single pattern, such as, for example, as illustrated in FIG. 3.

In use, the quilt blank 30 illustrated in FIG. 3 is completed by a user who purchased the quilt blank 30. As discussed above, the pattern 8 that is incorporated in the quilt top 2 of the quilt blank 30 may be any design. The design of the pattern 8 may be solely that of the quilt blank provider, may be a design dictated by the user, may be a collaboration of the user and the quilt blank maker, or any other pattern. Enabling the user to participate in designing the quilt pattern 8 may provide further commercial benefits to the quilt blank manufacturer, and creative satisfaction to the user. After the user obtains the quilt blank 30, the user may either combine the quilt top 2 with the batting and backing (not shown) by way of a sewing or quilting pattern (not shown), resulting in a configuration similar to that described above with respect to FIG. 2. Alternatively, the user may elect to complete the top first by selecting any type of material to fill in the blank portions 32, 34, 36, 38, 40, 42, 44 of the quilt blank 30. In either case, as described previously, the user may pattern and cut the materials to fit the blank portions 32, 34, 36, 38, 40, 42, 44, as appropriate. For example, one large block of cloth or other material may be used to fill in each blank portion or may use multiple pieces of material to fill in the blank areas. The blank portions 32, 34, 36, 38, 40, 42, 44 are filled in by patterning the selected material, cutting it to size, and sewing the patterned material into the appropriate areas within the blank portions. Once the patterned blocks of material (not shown) are incorporated into the blank portions 32, 34, 36, 38, 40, 42, 44, the user may complete the quilt by either combining the batting and backing using a sewing or quilting pattern or by completing the sewing or quilting pattern through the newly incorporated material depending upon the order in which the user elected to complete the quilt.

Figure 4:
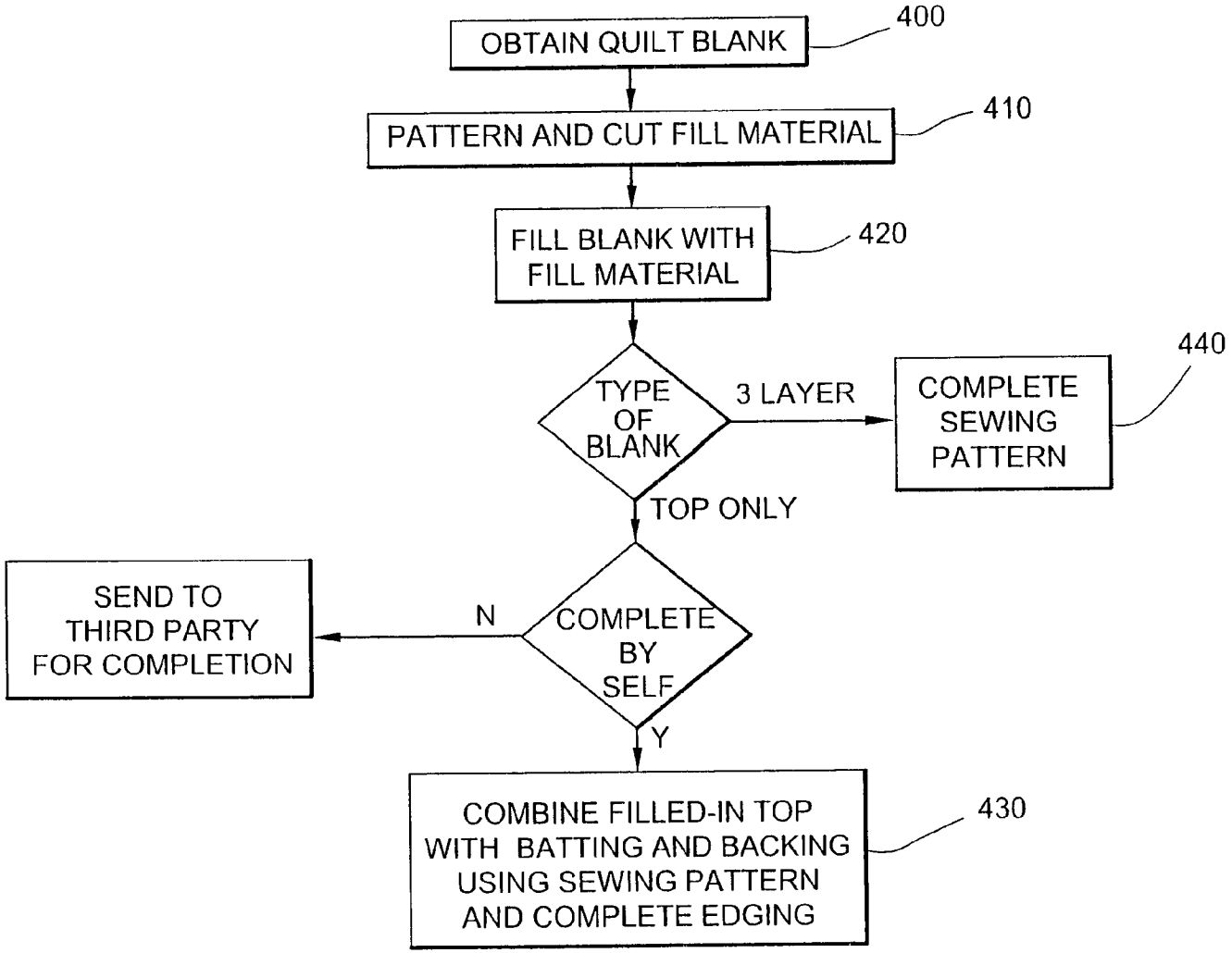
FIG. 4 is a flow chart illustrating a method of making a quilt using a quilt blank.

FIG. 4 is a flowchart illustrating a non-limiting exemplary method of making a quilt using a quilt blank according to embodiments disclosed herein. In step 400, a user may obtain a quilt blank separately or in the form of a kit, as will be described herein. The quilt blank may be, for example, in the form illustrated in FIG. 2 or 3 above. The user may then in step 410 pattern and cut the material for filling in the blank portions of the quilt blank obtained in step 400. As previously discussed, the material may be any material, such as, for example, material provided by the user, supplied by the provider of the quilt blank or quilt kit, or the like, or may optionally include other materials, such as, for example, ribbons, photographs etc. After patterning and cutting the material, the user may then sew the material into the appropriate blank or blanks in step 420. If the quilt blank purchased by the user was a blank quilt top then the user would complete the quilt by securing the batting and backing to the quilt top via a sewing pattern step 430. On the other hand, if the quilt blank purchased by the user is in the form of a partially completed quilt, e.g., a quilt top combined with batting and backing via a sewing or quilting pattern, wherein the quilt top included blank portions, the user may complete the quilt by simply completing the sewing or quilting pattern in step 440.

It is also contemplated that quilt blanks, such as, for example, the types described herein may be provided to a user in the form of a quilt kit. The quilt kit may include a quilt blank of any type that includes a quilt top having predetermined blank portions, and may optionally include patterns for patterning materials to be used to fill in the blank portions, materials (uncut or pre-cut according the blank portions) for filling in the blank portions of the quilt blank. In the case that the quilt blank being provided is only a quilt top having predetermined blank portions, the quilt kit may also optionally include batting and backing materials. Additionally, thread for completing the sewing pattern, edge finishing material, such as, for example, bias tape, edging material, etc., may be optionally included in the quilt kit. Any suitable combination of items may be included in a quilt kit with the quilt blank. The quilt kit may also optionally include instructions for the user to complete the quilt. It will also be understood that the patterns from which the blank portions of the quilt top of the quilt blank are made may include any number of shapes and sizes. For example, and without limitation, the patterns may include representations of flowers, geometric shapes, vehicles (e.g., trains, planes, automobiles, spaceships, etc.), known characters from dramatic and/or literary works, a letter or combination of letters, a toy, an animal etc.

While the foregoing quilt blank has been described in conjunction with illustrative non-limiting exemplary embodiments set forth herein, it will be appreciated that various changes may be made without departing from the true spirit and full scope of the invention as defined in the appended claims.

What is claimed is:

1. A quilt kit comprising:

a quilt top including a predetermined opening extending through said quilt top and being arranged to receive material in said predetermined opening; and instructions for combining said quilt top with a backing and a batting interposed between said quilt top and said batting, said batting overlapping said predetermined opening.

2. The quilt kit according to claim 1, wherein said instructions further comprise at least one instruction for securing said quilt top, batting and backing to each other.

3. The quilt kit according to claim 1, wherein said quilt top includes a plurality of openings extending through said quilt top.

4. The quilt kit according to claim 1, wherein said predetermined opening includes a plurality of subportions.

5. The quilt kit according to claim 1, wherein said predetermined opening is in a pattern in the shape of at least one of: a flower, a geometric shape, a vehicle, a train, a plane, an automobile, a letter or combination of letters, a literary or dramatic character, an animal or a toy.

6. The quilt kit according to claim 1, wherein a quilt made using the quilt kit is capable of being used for at least one of: a pillow, a pillow case, a bed spread, a throw, an oven mitt, a pot holder, or a wall hanging.

7. The quilt kit according to claim 1, wherein said material comprises at least one of: new fabric, vintage fabric, heirloom fabric, old baby clothes, silk ties, t-shirts, keepsake textiles, ribbons, photographs or non-textile materials.

8. A quilt blank, comprising:

a quilt top having a predetermined opening extending through said quilt top and sized to receive a fabric swatch or other material, wherein said quilt top is securely attached to a batting and a backing, the batting arranged to overlap said opening.

9. The quilt blank according to claim 8, wherein said quilt top includes a plurality of openings.

10. The quilt blank according to claim 8, wherein said predetermined opening includes a plurality of subportions.

11. The quilt blank according to claim 8, wherein said predetermined opening is in a pattern in the shape of at least one of: a flower, a geometric shape, a vehicle, a train, a plane, an automobile, a letter or combination of letters, a literary or dramatic character, an animal, or a toy.

12. The quilt blank according to claim 8, wherein said quilt blank is capable of being used for at least one of: a pillow, a pillow case, a bed spread, a throw, an oven mitt, a pot holder or a wall hanging.

13. The quilt blank according to claim 8, wherein said fabric swatch comprises at least one of: new fabric, vintage fabric, heirloom fabric, old baby clothes, silk ties, t-shirts, or keepsake textiles.

14. The quilt blank according to claim 8, wherein said other material comprises at least one of: ribbons, photographs, or non-textile material.

15. The quilt blank according to claim 8, wherein said batting completely overlaps said predetermined opening in said quilt top.

16. The quilt blank according to claim 8, wherein said batting substantially overlaps said predetermined opening in said quilt top.

17. A method of making a quilt kit, comprising:

providing a quilt top having a predetermined opening extending therethrough; and providing instructions for combining said quilt top, a batting and a backing, wherein said batting overlaps said predetermined opening extending through said quilt top.

18. The method of claim 17, wherein said quilt top includes a plurality of openings.

19. The method of claim 17, wherein said predetermined opening extending through the quilt top includes a plurality of subportions.

20. The method of claim 17, wherein said instructions further comprise at least one instruction for securing said quilt top, batting and backing to each other.

21. The method of claim 17, wherein said batting completely overlaps said predetermined opening.

22. The method of claim 17, wherein said batting substantially overlaps said predetermined opening.

* * * * *